US011986097B2

(12) United States Patent
Brown et al.

(10) Patent No.: US 11,986,097 B2
(45) Date of Patent: May 21, 2024

(54) MODULAR ADJUSTABLE RAIL SYSTEM

(71) Applicants: Daniel Scott Brown, Iron Mountain, MI (US); Yuedong Chu, Haining (CN); Tyler Elisworth Powell, Gig Harbor, WA (US)

(72) Inventors: Daniel Scott Brown, Iron Mountain, MI (US); Yuedong Chu, Haining (CN); Tyler Elisworth Powell, Gig Harbor, WA (US)

( * ) Notice: Subject to any disclaimer, the term of this patent is extended or adjusted under 35 U.S.C. 154(b) by 162 days.

(21) Appl. No.: 17/476,275

(22) Filed: Sep. 15, 2021

(65) Prior Publication Data

US 2023/0083746 A1 Mar. 16, 2023

(51) Int. Cl.
*A47C 4/02* (2006.01)
*A47C 17/86* (2006.01)

(52) U.S. Cl.
CPC ..... *A47C 4/02* (2013.01); *A47C 17/86* (2013.01)

(58) Field of Classification Search
CPC ..... A47C 4/02; A47C 17/86; A47C 13/005
See application file for complete search history.

(56) References Cited

U.S. PATENT DOCUMENTS 3,215,382 A * 11/1965 Stein ..... A47D 11/02 248/172
5,599,031 A * 2/1997 Hodges ..... B62B 5/0083 280/35
5,996,145 A * 12/1999 Taylor ..... A47C 19/045 5/310
6,125,484 A * 10/2000 Thomson ..... A47C 19/04 5/200.1
10,470,582 B2 * 11/2019 Odutayo ..... A47C 7/002
10,499,745 B2 * 12/2019 Adams ..... A47C 17/86
2012/0126085 A1 * 5/2012 Johnson ..... A47C 7/002 248/346.03
2015/0320221 A1 * 11/2015 Williams ..... A47C 7/62 248/188.5

(Continued)

FOREIGN PATENT DOCUMENTS

CH 152556 A * 2/1932
CN 210989268 U * 7/2020

(Continued)

OTHER PUBLICATIONS

Rockler plastic guide rails in grooved drawers sold on amazon, first available date Jun. 22, 2008, https://www.amazon.com/White-Plastic-Guide-Grooved-Drawers/dp/B004RAJOZA (Year: 2008).*

(Continued)

*Primary Examiner* — Terrell L McKinnon
*Assistant Examiner* — Ding Y Tan
(74) *Attorney, Agent, or Firm* — DICKINSON WRIGHT RLLP

(57) ABSTRACT

A modular rail system for reclining furniture using an adjustable rail system that allows any furniture to expand modules or reduce modules and remain functional and operable. The modular adjustable rail system allows modular seating, or other pieces, to be connected or removed using an adjustable rail system offering multiple ways to add or subtract pieces of furniture. The adjustable rail system also allows for the spacing between each module to be adjusted.

10 Claims, 12 Drawing Sheets

(56) References Cited

U.S. PATENT DOCUMENTS

| | | | | |
|---|---|---|---|---|
| 2017/0027319 | A1* | 2/2017 | Lingmann | A47C 3/38 |
| 2018/0078041 | A1* | 3/2018 | Nelson | A47C 4/028 |
| 2020/0069070 | A1* | 3/2020 | Odutayo | A47C 19/027 |

FOREIGN PATENT DOCUMENTS

| | | | |
|---|---|---|---|
| CN | 214156794 | U * | 9/2021 |
| TW | 1590787 | B1 * | 7/2017 |

OTHER PUBLICATIONS

CSFMC furniture leveler sold on amazon, first available date: Aug. 4, 2021, https://www.amazon.com/CSFMC-Furniture-Adjustable-Installation-Protection/dp/B09BVXP73T?th=1 (Year: 2021).*

Zinus compack metal adjustable bed frame sold on amazon, first available date: Sep. 17, 2015, https://www.amazon.com/Zinus-Compack-Adjustable-Spring-Mattress/dp/B015IHMK5C?th=1 (Year: 2015).*

Mojodesk assembly video on youtube dated Sep. 22, 2020, https://www.youtube.com/watch?v=E39aPILX9-o (Year: 2020).*

Mojodesk assembly instructions dated Jun. 18, 2019, https://cdn.shopify.com/s/files/1/1358/2307/files/MojoDesk_Assembly_Online_Instructions_6-28-19.pdf?42907 (Year: 2019).*

Eatheaty wooden center mount drawer slides with guide track sold on amazon.com dated Jul. 13, 2021, https://www.amazon.com/Wooden-Classic-Traditional-Replacement-Inforcement/dp/B09999TQYQ (Year: 2021).*

System Plast 2015 convey components chains and belts catalog, issue 6.2, https://www.regalrexnord.com/-/media/Files/Literature/Industries/System_Plast_Conveyor_Components_Form_9228E.pdf (Year: 2015).*

Craftsmanspace online article titled "17 ways to fasten a tabletop" dated Sep. 27, 2020 by archive.org, https://www.craftsmanspace.com/woodworking-joints/17-ways-to-fasten-a-tabletop (Year: 2020).*

Wafjamf adjustable furniture leveling feet threaded screw sold on amazon, dated Aug. 26, 2019, https://www.amazon.com/Betterfou-Furniture-Leveling-Adjustable-Diameter/dp/B07SFMBWPD?th=1 (Year: 2019).*

SnugStop bed wedge and gap filler for headboard and mattress, dated May 28, 2019, sold on amazon.com, https://www.amazon.com/SnugStop-Mattress-Headboard-Pillow-Filler/dp/B07RF2YQMH (Year: 2019).*

* cited by examiner

MODULAR ADJUSTABLE RAIL SYSTEM

BACKGROUND OF THE INVENTION

Field of the Invention

The present invention relates to modular adjustable furniture, and more particularly, to an adjustable rail system that allows for adding or removing modularity of reclining seating systems. The modular system uses the adjustable rail to expand and contract allowing the modular assembly and disassembly of reclining furniture and its module components. The modular expansion and reduction system offer multiple ways to seamlessly add or subtract pieces of reclining furniture and/or adjust spacing between the modules on an adjustable rail system.

Background and Related Art

Conventional rail systems used for reclining furniture or modular seating are not adjustable. Because conventional rail systems used for reclining furniture or furniture with functions such as consoles are designed to operate on a fixed rail system, the user has to buy the furniture in a single configuration without the ability to add or subtract pieces and/or adjust spacing between the modules. The framework of said furniture is made to order as to the combinations of moving and static modules that once assembled are set for the remainder of the furniture's life cycle. Additionally, conventional modular construction systems do not support expansion and contraction of modular reclining furniture.

Conventional reclining furniture and modular constructed rail systems require retailers to maintain various stock keeping units and additional inventory based on the anticipated consumer market, using vast amounts of storage space. The wider the options a furniture retailer wants to provide, the greater storage space is required to maintain the different variations of the assembled combinations of reclining and modular furniture. This creates increased costs for both the manufacturer and retailer-distributor, thus costing consumers more than necessary. This also restricts the consumers ability to use the furniture in a limited number of applications based on the size of the assembled furniture and the room in it is maintained.

In the current marketplace, no option allows for consumers to customize or adjust their reclining furniture's modular pieces according to their needs, given the conventional modular constructed rail system's limited customization capacities. For example, two consumers may have multiple varying tastes and needs in reclining furniture from seating options to modular storage options. The multiple of these combinations requires vast storage capabilities to address all potential furniture variations. Prior patents concerning modular reclining furniture construction systems do not solve this problem; they do not allow for the adding and removing of the modular furniture pieces after the product is manufactured and assembled. They restrict the customization for the retailer and consumer to conveniently add or remove pieces of a modular fashion on a rail system. They also do not allow for adjustment of spacing between the pieces.

Further, the conventional modular constructed rail systems are not cost-effective to ship or store and are often difficult to transport. They are not beneficial to the consumer who may downsize or upsize their living situation, rendering the furniture purchased for a certain sized room often obsolete.

SUMMARY OF INVENTION

It is therefore the primary objective of the present invention to provide modular adjustable rail system allowing retailers and consumers to add or remove pieces of modular reclining furniture and components in multiple ways using an adjustable rail system that provide the same stability and support as a traditional fixed system.

It is another objective of the present invention to allow the manufacturer, retailer and consumer a choice to create customized modular reclining furniture with an option of multiple configurations, or to expand or contract the modular furniture at a later date.

It is another objective of the present invention to adjust spacing between modules to prevent rubbing or reduce gaps between modules.

It is still another objective of the present invention to provide the opportunity to the retailer to limit the amount of inventory on hand, while at the same time maintain multiple variations of the furniture to address consumer demand.

It is still another objective of the present invention to provide a modular expansion system having an adjustable single rail system with stronger and tighter connectivity between two or more modular furniture pieces than conventional rail systems, thus adding significantly more durability and stability.

It is still another objective of the present invention to provide a modular adjustable rail system allowing the pieces of the modular reclining furniture and components to come apart easily to facilitate transportation and movement in tight spaces such as hallways and stairwells, which previously would not be accessible, resulting in smaller packages and reducing storage, shipping, and transport costs. It also allows for easier replacement of an individual module that is damaged instead of replacing the entire unit.

It is still another objective of the present invention to provide a modular adjustable rail system allowing the consumer to customize the modular reclining furniture to be both space-efficient and stable.

The objectives, features, functions, and advantages of the present invention will be more readily understood upon a thoughtful deliberation of the following detailed description of the present invention with reference to the accompanying drawings.

DESCRIPTION OF THE DRAWINGS

Description of the Drawings

Figure 1:
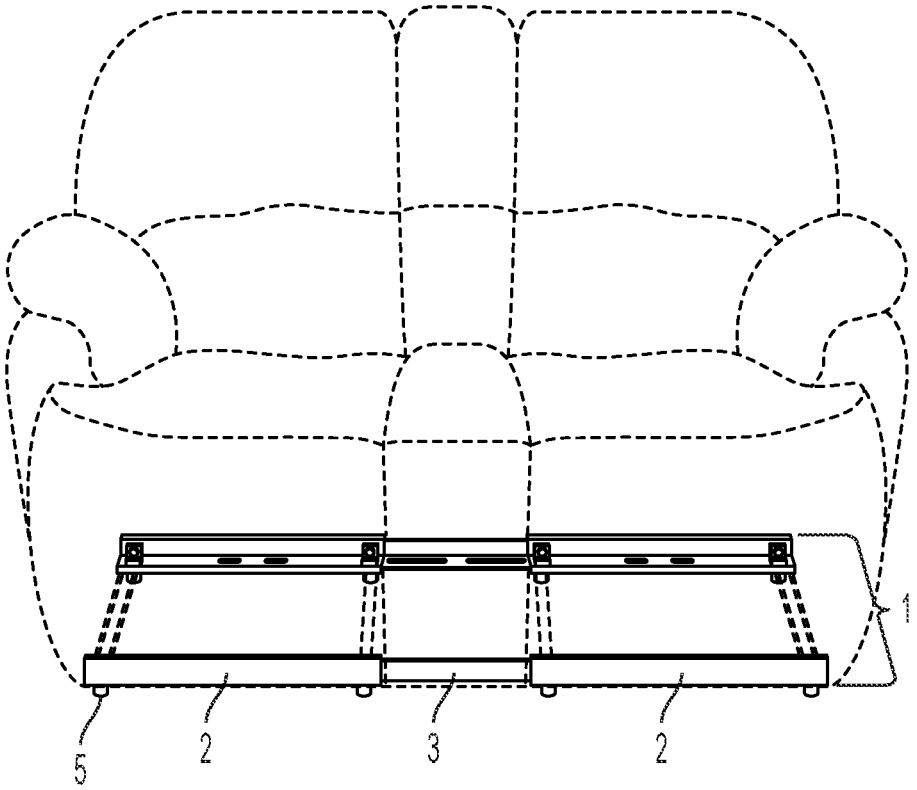
Figure 2:
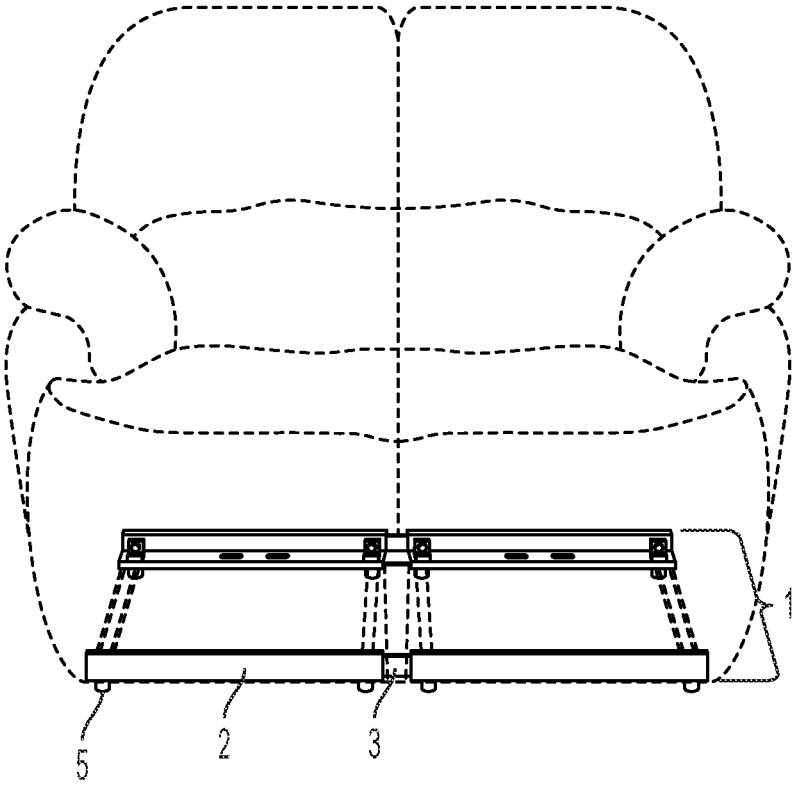
Figure 3:
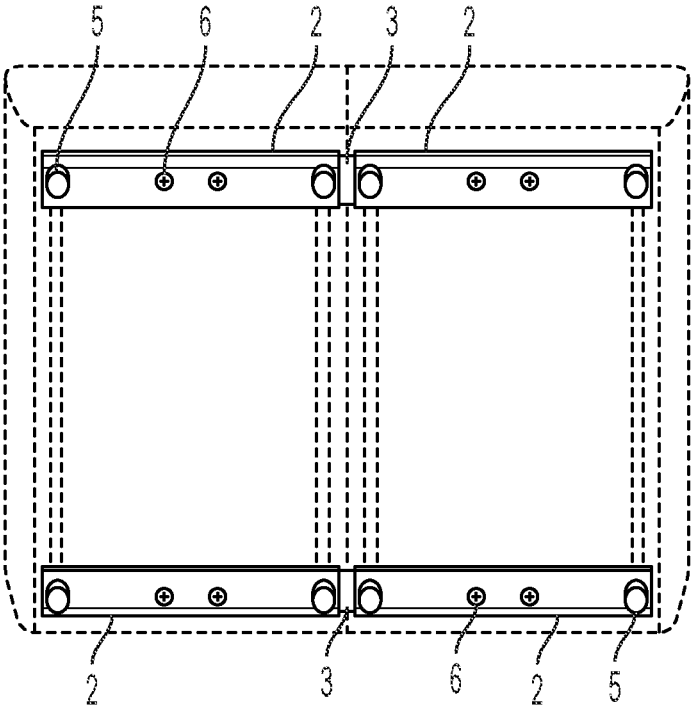
Figure 4A:
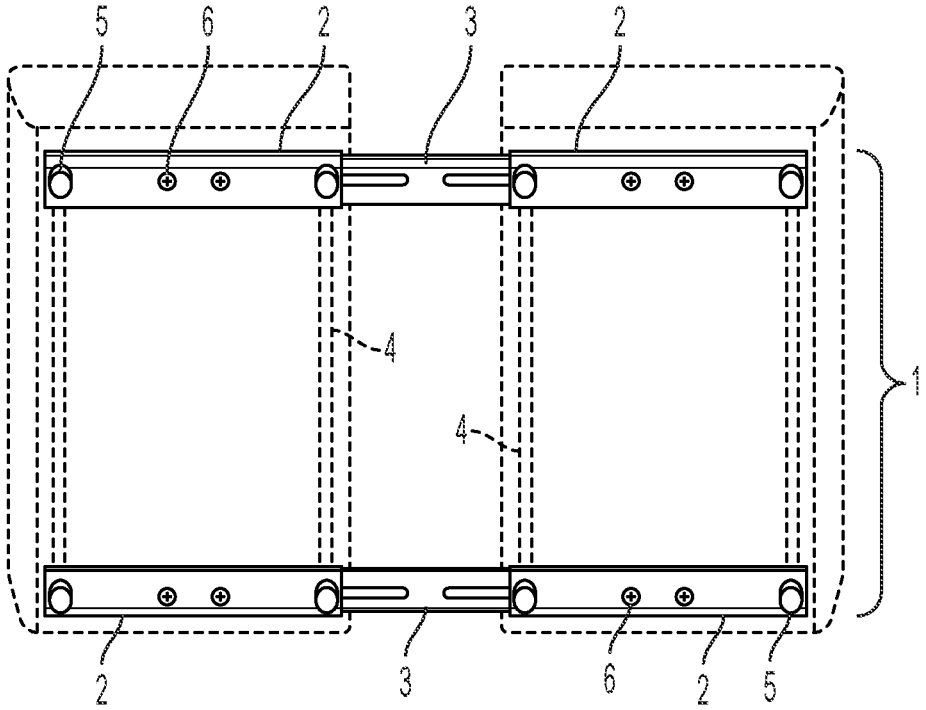
Figure 4B:
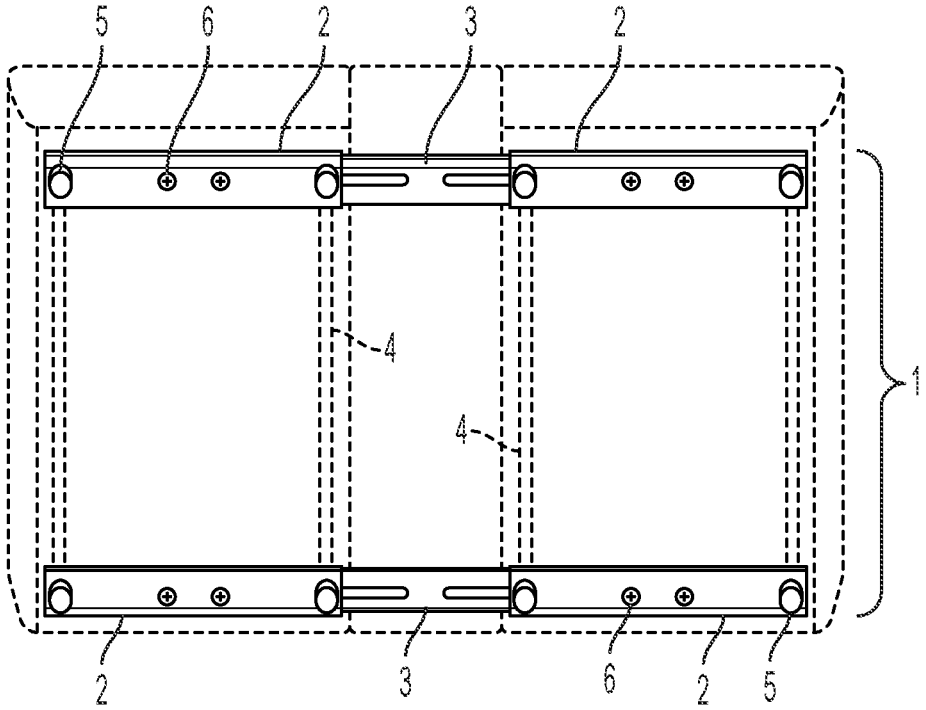
Figure 4C:
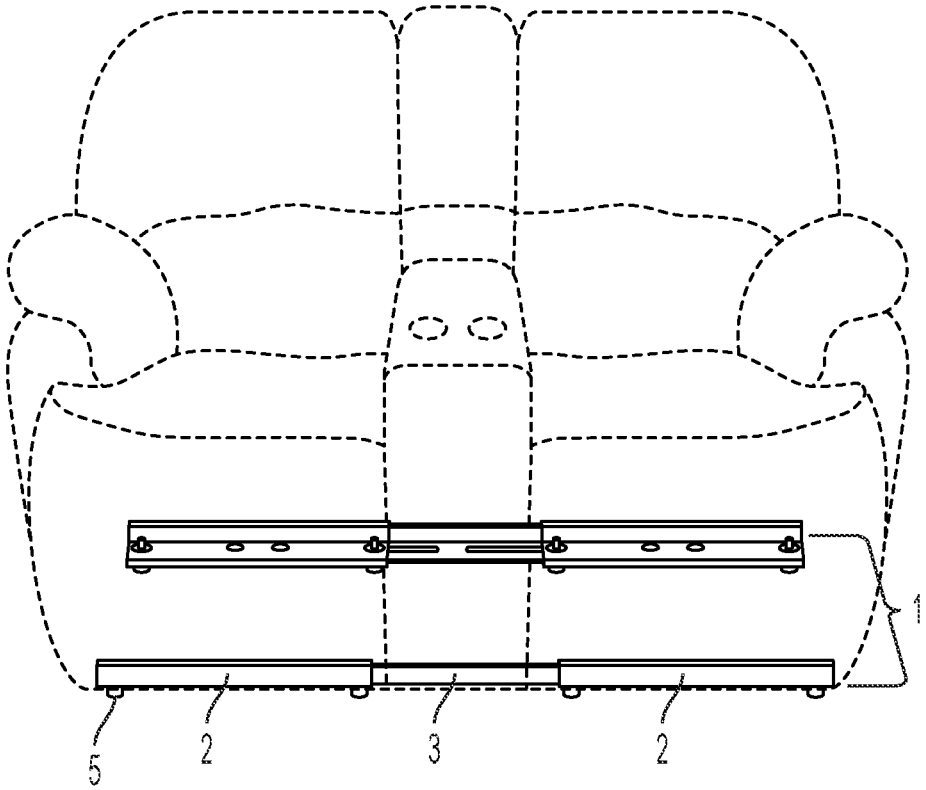
Figure 5:
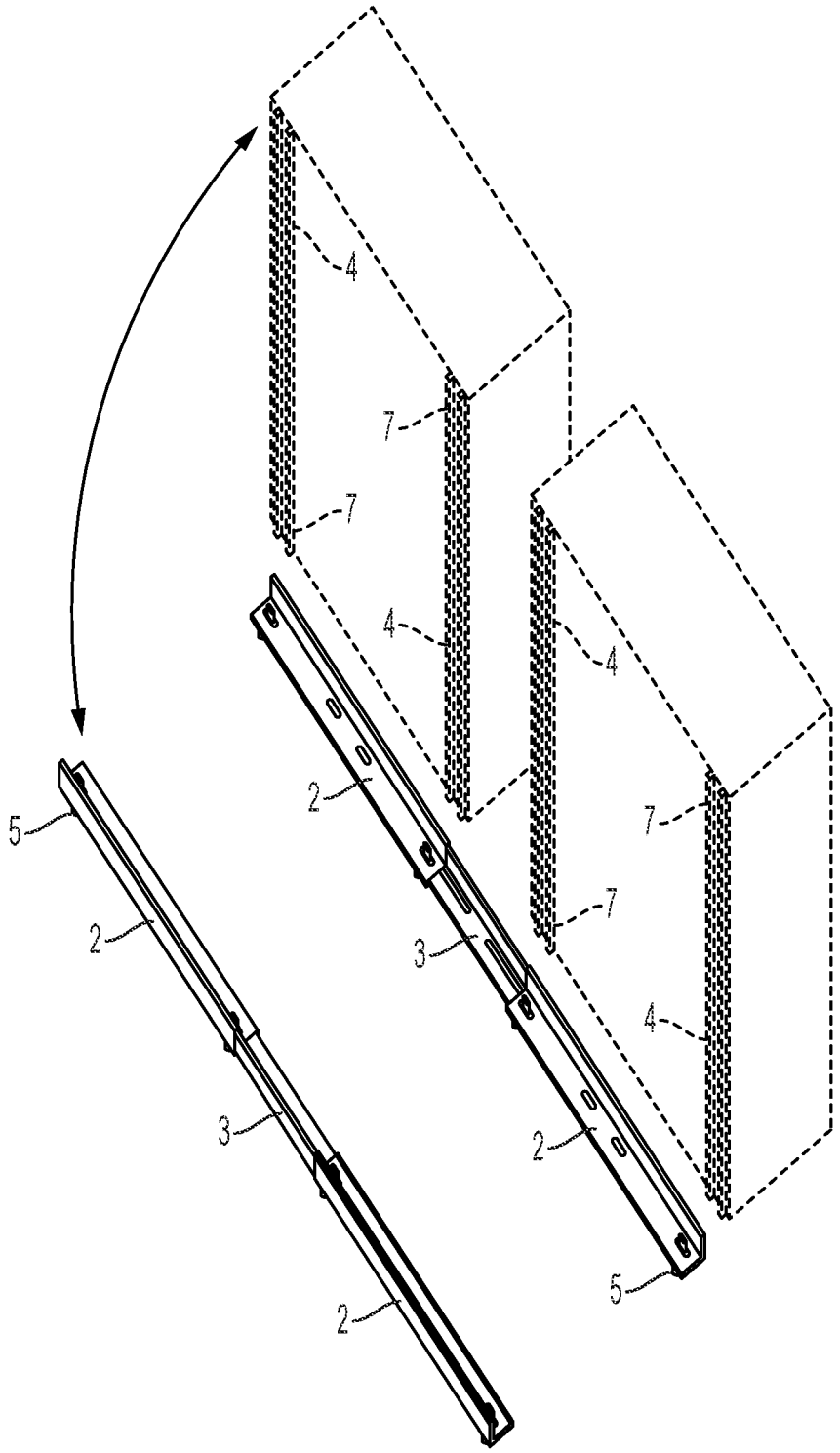
Figure 6:
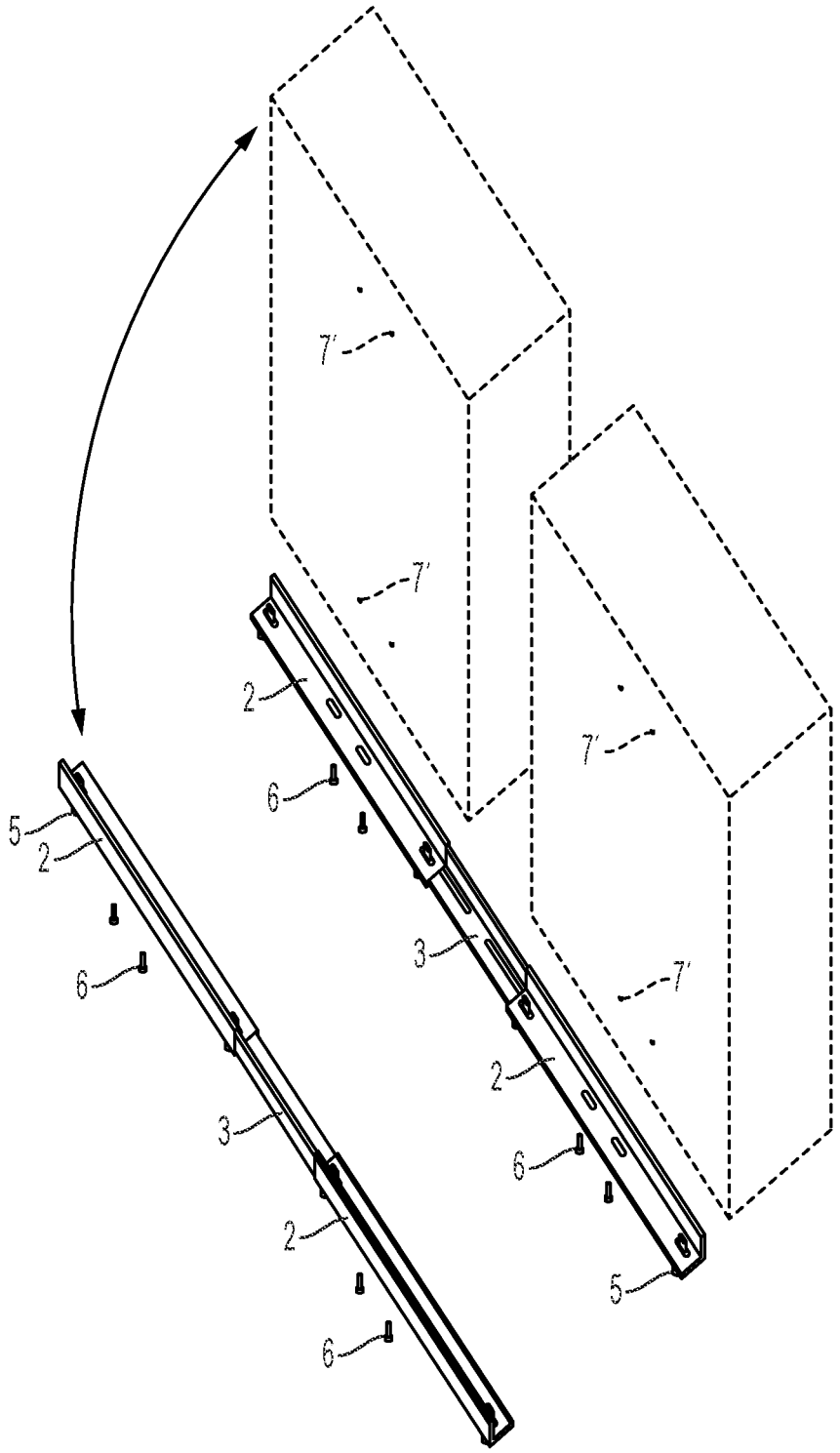
Figure 7:
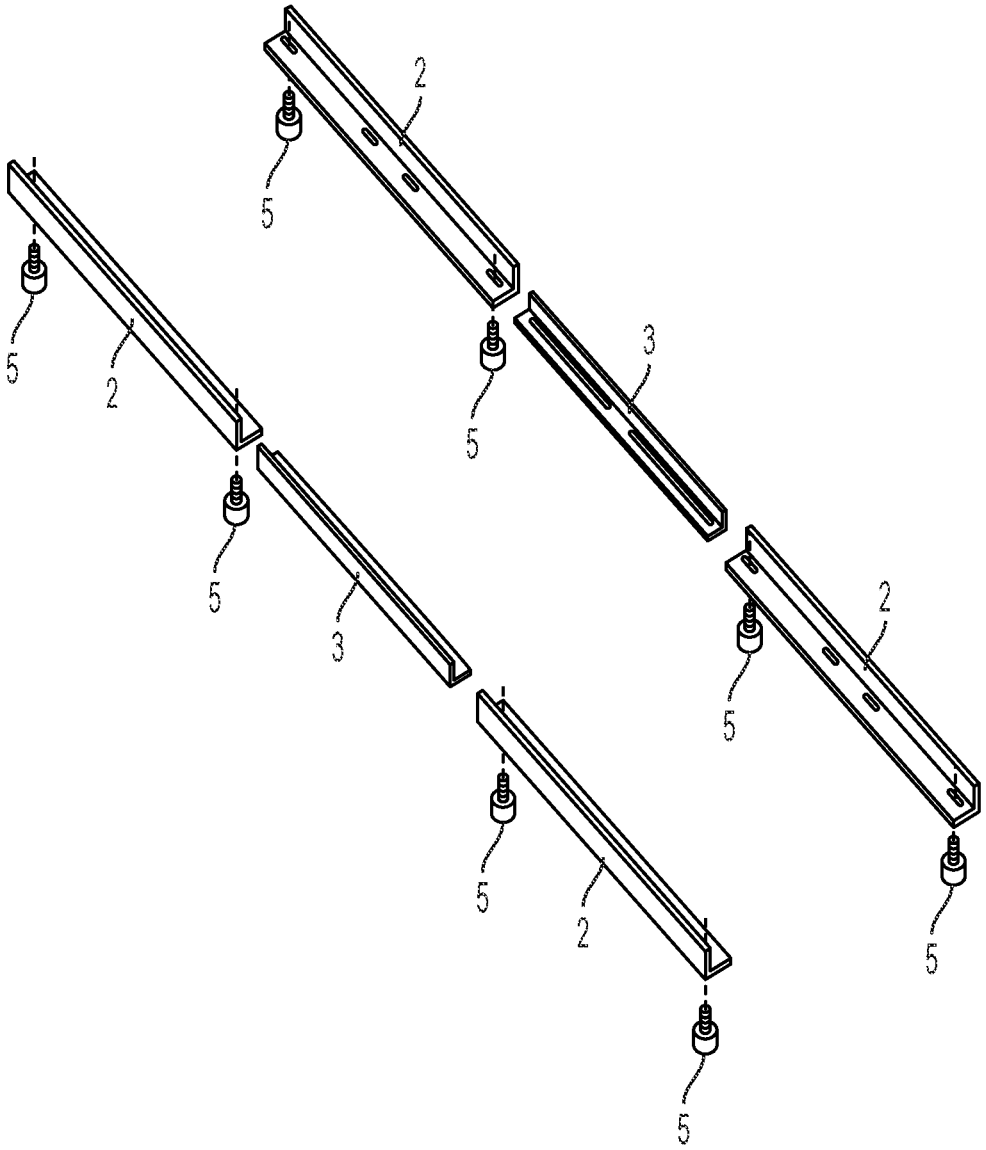
Figure 8:
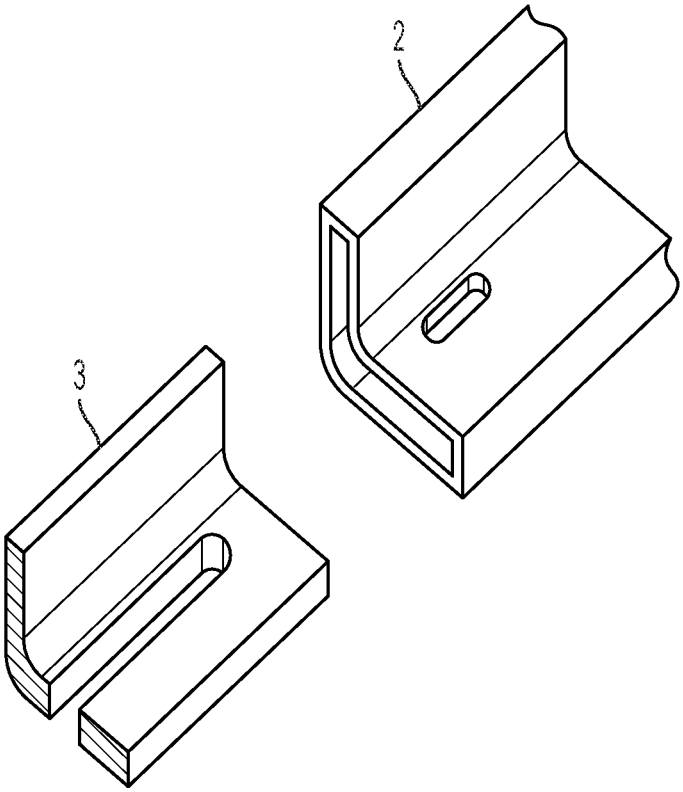
Figure 9:
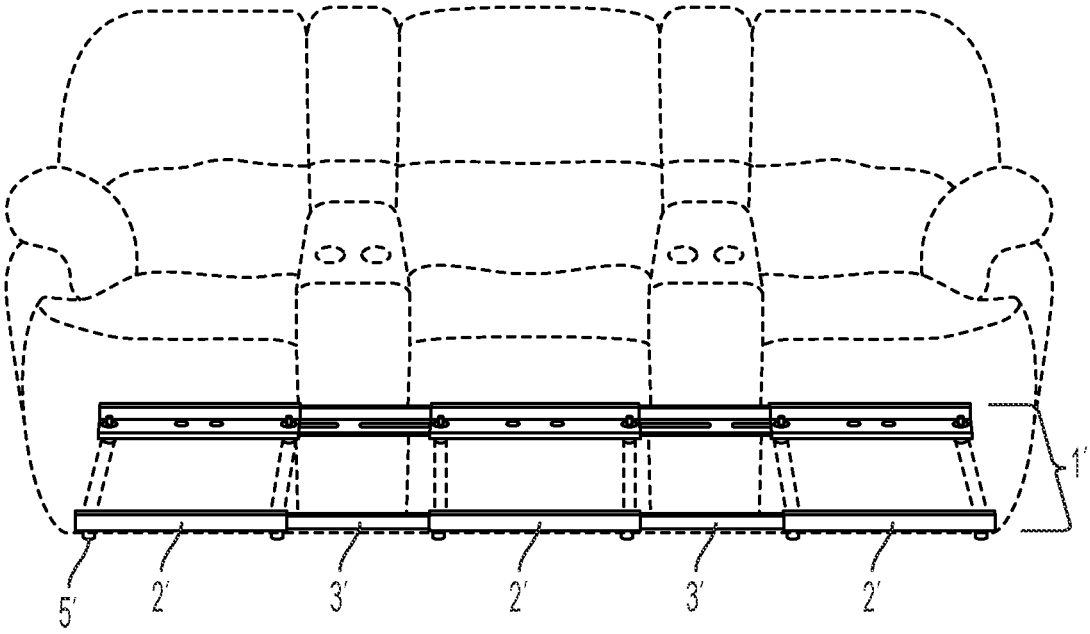
Figure 10:
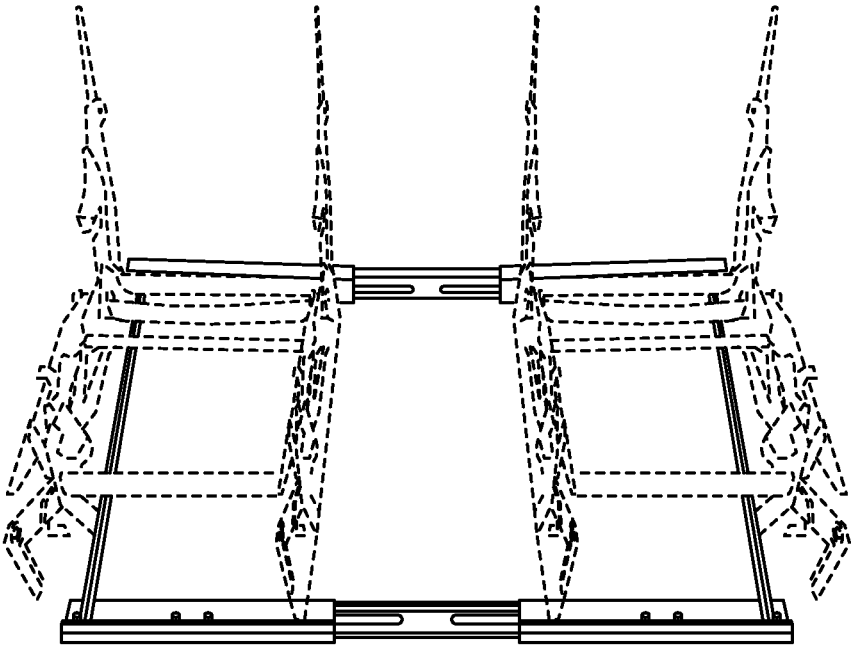

The invention will be readily understood by the following detailed description in conjunction with the accompanying drawings, wherein like reference numerals designate like structural elements, and in which:

FIG. 1 illustrates a front side perspective view the adjustable rail system design highlighting the adjustable feature in the center through one rail-mountable insert (3) fully extended between two base frames (2), further illustrated by an additional middle seat on the furniture;

FIG. 2 illustrates a front side perspective view of the adjustable rail system design highlighting the retractable feature of the rail-mountable insert (3) fully retracted within the two base frames (2), further illustrated by the removal of the middle seat on the furniture;

FIG. 3 illustrates a bottom perspective view of the adjustable rail system design, highlighting the retractable rail-mountable insert feature (3), fully retracted within the two base frames (2) wherein the system is attached by two separate means (6) or (5);

FIG. 4(A) illustrates a concentrated bottom perspective view of the adjustable rail system design, highlighting the extendable feature of the rail-mountable insert (3) fully extended between two base frames (2), further illustrated without the middle furniture piece attached, wherein the system is attached by two separate means (6) or (5);

FIG. 4(B) illustrates a concentrated bottom perspective view of the adjustable rail system design, highlighting the extendable feature of the rail-mountable insert (3) fully extended between two base frames (2), further illustrated with space provided to add a middle furniture module;

FIG. 4(C) illustrates a front side perspective view of the adjustable rail system design, highlighting the extendable feature of the rail-mountable insert (3) fully extended between two base frames (2), further illustrated by a middle furniture piece attached;

FIG. 5 illustrates an upper right-side perspective view of the adjustable rail system design, highlighting how the system interfaces with the modules as built, prior to being attached by attachable feet (5);

FIG. 6 illustrates an upper right-side perspective view of the adjustable rail system design, highlighting how the system interfaces with the modules as built, prior to being attached by attachable feet (5) and screws (6);

FIG. 7 illustrates an upper right-side perspective view of the adjustable rail system design, highlighting how the feet of each furniture module are integrates in the base frame to allow for fixed connectivity with the furniture pieces;

FIG. 8 illustrates a concentrated upper right-side perspective view of the adjustable rail system design, highlighting that the rail inserts (3) are connected within the rail bases (2), as to allow for a retractable and extendable motion without having to take apart the entire rail base and inserts;

FIG. 9 illustrates a front side perspective view of the adjustable rail system design, highlighting the extendable feature through two sets of rail-mountable inserts (3) fully extended between three adjoining base frames (2);

FIG. 10 illustrates a front perspective view of the adjustable rail system design highlighting the reclining mechanisms attached to the base frames (2).

SPECIFIC DESCRIPTION OF THE PREFERRED EMBODIMENT

The illustrated embodiments of the invention will be best understood by reference to the drawings, wherein like parts are designated by like numerals or other labels throughout. The following description is intended only by way of example, and simply illustrates certain selected embodiments of the present invention herein.

FIG. 1—depict the preferred embodiment of the present invention. This figure shows the rail base (3) expanded in the base frame (2) to allow the addition of a modular center furniture piece and two loungers attached to the base frame (2) using the removable feet that pass through the rail system (1) and connect to the furniture modules.

FIG. 2—depict the preferred embodiment of the present invention. This figure shows the rail system (1) with the rail base (3) retracted within the base frame (2) as connected to two loungers.

FIG. 3—depict an alternative embodiment of the present invention. This figure shows the rail system (1) with the rail base (3) retracted within the base frame (2) connected to two loungers using the removable feet (5) that pass through the rail system and connect to the furniture modules and by the use of additional screws (6) that also pass through the rail system (1).

FIG. 4*a-b-c* depict an alternative embodiment of the present invention. These figures depict the rail system (1) with the rail base (3) expanded within the base frame (2) connected to two loungers using the removable feet (5) that pass through the rail system and connect to the furniture modules and by the use of additional screws (6) that also pass through the rail system (1) to create space to insert a middle module between the two loungers.

FIG. 5—depict the preferred embodiment of the present invention. This figure shows the rail system (1) with the rail base (3) expanded within the base frame (2) before it is attached to the bottom of each of the depicted modular bases of the furniture.

FIG. 6—depict an alternative embodiment of the present invention. This figure shows the rail system (1) with the rail base (3) expanded within the base frame (2) before it is attached to the bottom of each of the depicted modular bases of the furniture, by use of the attachable feet (5) and additional screws (6).

FIG. 7—depict the preferred embodiment of the present invention. This figure shows the rail system (1) with the rail base (3) expanded within the base frame (2) and the attachable feet (5) and additional screws (6).

FIG. 8—depict the preferred embodiment of the present invention. This figure shows the interaction of the rail system (1) where the rail base (3) inserts within the base frame (2).

FIG. 9—depict the preferred embodiment of the present invention. This figure shows two pair of rail base (3) expanded into a plurality of the base frame (2) to allow the addition of two modular center furniture pieces and three loungers attached to the rail system (1).

FIG. 10—depict the preferred embodiment of the present invention. This figure shows the rail system (1) with the rail base (3) expanded within the base frame (2) after being attached to two recliners.

SPECIFIC DESCRIPTION OF THE PREFERRED EMBODIMENT

An adjustable rail system for modular furniture, comprising: a rail base housed within a base frame; said base frame is hollow and rigid; said rail base is solid and rigid with a length less than or equal to two said base frames; wherein each said rail base is housed within a pair of said base frames allowing for elongation or retraction of said rail system to remove or insert a plurality of furniture module(s); wherein said adjustable rail system is made up of a plurality of said rail bases and a plurality of said base frames; and wherein said frame housings are permanently mounted to the bottom of a plurality of furniture module(s).

The foregoing adjustable rail system, wherein: said base frame and base rail are made of metal. The adjustable rail system as recited in claim 1 wherein: said base frame and base rail are made of wood.

The foregoing adjustable rail system, wherein: said base frame and base rail are made of plastic.

The foregoing adjustable rail system, wherein: said base frames are mounted to the base portion of the furniture module by glue.

The foregoing adjustable rail system, wherein: said base frame are mounted to the bottom portion of the furniture module by bolts or screws that pass through said adjustable rail system and into said furniture module.

The foregoing adjustable rail system, wherein: said base frames are mounted to the bottom portion of the furniture module by bolts or screws that also function as feet for said furniture module.

The foregoing adjustable rail system, wherein: said base frames are permanently mounted to the base portion of the furniture module by welding of said base frames to said furniture mode.

We claim:

1. An adjustable rail system for modular furniture, the adjustable rail system comprising:

at least two rail bases, wherein each rail base of the at least two rail bases:

is solid and rigid, has respective ends that are inserted into a respective pair of base frames that are hollow and rigid, has a length that is less than or equal to a combined length of the respective pair of base frames, and has a respective at least one passthrough feature; and the pairs of base frames, wherein, for a given pair of the pairs of base frames, each base frame is attached to a respective furniture module, such that when the base frames are pulled apart from one another:

at least a portion of the respective rail base that is inserted into the base frames, as well as the respective at least one passthrough feature, is exposed, and a furniture module cavity is established between the respective furniture modules to accept an additional furniture module between the respective furniture modules, wherein the additional furniture module is attached to the adjustable rail system by way of the respective at least one passthrough feature.

2. The adjustable rail system as recited in claim 1, wherein the base frames and rail bases are made of metal.

3. The adjustable rail system as recited in claim 1, wherein the base frames and rail bases are made of wood.

4. The adjustable rail system as recited in claim 1, wherein the base frames and rail bases are made of plastic.

5. The adjustable rail system as recited in claim 1, wherein each base frame is attached to its respective furniture module by glue.

6. The adjustable rail system as recited in claim 1, wherein each base frame is attached to its respective furniture module by welding.

7. The adjustable rail system as recited in claim 1, wherein each base frame is attached to its respective furniture module by bolts or screws that pass through the base frame and into the respective furniture module.

8. The adjustable rail system as recited in claim 7, wherein respective ends of the bolts or screws function as feet for the adjustable rail system.

9. The adjustable rail system as recited in claim 1, wherein the additional furniture module is attached to the adjustable rail system by way of the respective at least one passthrough feature using bolts or screws.

10. The adjustable rail system as recited in claim 9, wherein respective ends of the bolts or screws function as feet for the adjustable rail system.

* * * * *